US010294906B2

(12) United States Patent
Lucas

(10) Patent No.: US 10,294,906 B2
(45) Date of Patent: May 21, 2019

(54) ELECTRONICALLY CONTROLLED INLET METERED SINGLE PISTON FUEL PUMP

(71) Applicant: Stanadyne LLC, Windsor, CT (US)

(72) Inventor: Robert G. Lucas, Ellington, CT (US)

(73) Assignee: Stanadyne LLC, Windsor, CT (US)

( * ) Notice: Subject to any disclaimer, the term of this patent is extended or adjusted under 35 U.S.C. 154(b) by 664 days.

(21) Appl. No.: 14/771,938

(22) PCT Filed: Mar. 3, 2014

(86) PCT No.: PCT/US2014/019902

§ 371 (c)(1),
(2) Date: Sep. 1, 2015

(87) PCT Pub. No.: WO2014/137900

PCT Pub. Date: Sep. 12, 2014

(65) Prior Publication Data

US 2016/0010607 A1 Jan. 14, 2016

Related U.S. Application Data

(60) Provisional application No. 61/772,625, filed on Mar. 5, 2013.

(51) Int. Cl.

| | |
|---|---|
| ***F02M 59/36*** | (2006.01) |
| ***F04B 1/04*** | (2006.01) |
| ***F04B 7/00*** | (2006.01) |
| ***F04B 53/10*** | (2006.01) |

(Continued)

(52) U.S. Cl.

CPC ..... *F02M 59/366* (2013.01); *F02M 37/0058* (2013.01); *F02M 59/367* (2013.01); *F02M 59/368* (2013.01); *F04B 1/0452* (2013.01); *F04B 7/0076* (2013.01);

(Continued)

(58) Field of Classification Search

CPC .... F04B 7/0076; F04B 13/00; F04B 53/1082; F23K 2900/05141; F23K 2900/05001; F23K 2203/203; F23K 5/002; F23K 5/007; F02M 59/366; F02M 59/367;

(Continued)

(56) References Cited

U.S. PATENT DOCUMENTS 3,709,639 A * 1/1973 Suda ..... F02M 59/366 123/499
4,475,513 A * 10/1984 Flaig ..... F02M 59/366 123/446

(Continued)

*Primary Examiner* — Bryan Lettman
(74) *Attorney, Agent, or Firm* — Alix, Yale & Ristas, LLP

(57) ABSTRACT

In a fuel pump and method of operation, an infeed for low pressure fuel leads to a pumping chamber where in an intake phase low pressure fuel is drawn into the pumping chamber and in a pumping phase high pressure fuel is delivered to a common rail. An inlet metering valve and an inlet check valve are upstream of the pumping chamber, and a control system closes the metering valve when no fuel is to be pumped to the common rail. The inlet check valve is also opened while the inlet metering valve is closed and no fuel is to be pumped to the rail. The inlet metering valve can include a proportionally controlled piston that produces a variable quantity of feed fuel and is closable for the no-demand condition with a maximum travel that contacts and holds open the inlet check valve.

16 Claims, 5 Drawing Sheets

(51) Int. Cl.
*F02M 37/00* (2006.01)
*F02M 51/06* (2006.01)

(52) U.S. Cl.
CPC ..... *F04B 53/1082* (2013.01); *F02M 51/06* (2013.01); *F02M 2200/09* (2013.01)

(58) Field of Classification Search
CPC ..... F02M 59/368; F02M 37/0029; F02M 2025/0845; F02M 51/06
See application file for complete search history.

(56) References Cited

U.S. PATENT DOCUMENTS

| | | | | |
|---|---|---|---|---|
| 6,116,870 | A * | 9/2000 | Kraemer | F02M 59/464 417/490 |
| 6,345,608 | B1 * | 2/2002 | Rembold | F02M 59/34 123/506 |
| 6,358,024 | B1 | 3/2002 | Djordjevic | |
| 6,651,630 | B2 * | 11/2003 | Hiraku | F02M 59/368 123/458 |
| 7,401,594 | B2 | 7/2008 | Usui et al. | |
| 7,527,035 | B2 | 5/2009 | Schroeder | |
| 7,540,274 | B2 * | 6/2009 | Yamada | F02M 59/442 123/496 |
| 7,690,361 | B2 | 4/2010 | Vogt et al. | |
| 7,707,996 | B2 | 5/2010 | Yamada et al. | |
| 2004/0096346 | A1 | 5/2004 | Usui et al. | |
| 2005/0126539 | A1 * | 6/2005 | Okamoto | F02D 41/062 123/446 |
| 2011/0265765 | A1 * | 11/2011 | Furuhashi | F02D 41/08 123/446 |

* cited by examiner

ELECTRONICALLY CONTROLLED INLET METERED SINGLE PISTON FUEL PUMP

BACKGROUND

The present invention relates to the control of high pressure fuel supply pumps.

Gasoline direct injection (GDI) fuel systems typically impose extra costs on original equipment vehicle manufacturers compared to conventional multi-port injection (MPI) systems. In addition to the in-tank low pressure feed pump, GDI systems also require an engine mounted high pressure pump. The higher pressures required for the GDI systems have also proven to be audibly louder. In the past few years, there have been some gains in driving down the cost of the GDI fuel pump through simplification and size reduction. However, noise remains a key customer complaint.

Current state of the art GDI pumps as disclosed in Hitachi, U.S. Pat. No. 7,401,594 and Bosch, U.S. Pat. No. 7,707,996 employ a digital on/off-type solenoid control for accurately timing opening and closing of the inlet check valve with respect to the cam pumping ramp. In these types of pumps, the pumping chamber fully charges during every cycle. When the inlet check valve is opened a backflow of pumped fuel is spilled into the low pressure portion of the fuel circuit. Those embodiments suffer from high audible noise associated with the opening and closing impacts of the high speed on/off-type solenoid operated valve. Additionally, the backflow causes excess pressure pulsations in the inlet line that are countered by the pump supplier adding inlet pressure dampeners.

SUMMARY

The disclosed improvements simplify and reduce the cost of a GDI single piston pump, as well as reducing the noise level and inlet pressure pulsations produced by the pump.

The improvement comprises that the inlet check valve is opened while the inlet metering valve is closed and no fuel is to be pumped to the common rail.

In the disclosed embodiment, the pump output is varied by electronic control of a proportional solenoid operated inlet metering valve. The inlet metering valve assembly is adjacent to or incorporates the pump inlet check valve. The inlet check valve is also in part controlled by the proportional solenoid when zero fuel delivery is commanded, thereby achieving a robust method of complete pump output shut-off when desired.

The proportional solenoid operated inlet metering valve is positively positioned for a given desired flow, thereby eliminating advance characteristics associated with pumps that use high speed, on/off-type solenoid operated valves. The lower pressure rise rate in the pumping chamber associated with inlet metering results in less audibly generated noise during partial load operation. Additionally, the inlet metering principle eliminates the need for a low pressure pump mounted pulsation damper due to the eliminated backflow that is associated with conventional GDI single piston pump operating principles characterized by the pumping chamber being fully charged during each pumping event.

The disclosure of an apparatus embodiment is directed to a fuel pump comprising an infeed passage for low pressure feed fuel; a pumping chamber in fluid communication with the infeed passage; a pumping plunger reciprocable in the pumping chamber between an intake phase that draws low pressure fuel from the infeed passage into the pumping chamber and a pumping phase that increases the pressure for delivery to a common rail through a discharge valve; an inlet metering valve in the infeed passage for delivering metered quantities of low pressure feed fuel through a variable opening to the pumping chamber, including a closed position of the metering valve corresponding to zero flow through the variable opening to the pumping chamber; an inlet check valve between the metering valve and the pumping chamber, biased to permit feed flow to the pumping chamber during the intake phase and to prevent fuel pumped at high pressure from flowing into the infeed passage during the pumping phase; an actuator for varying the opening of the inlet metering valve commensurate with infeed fuel quantity demand for the intake phase in the pumping chamber; and means for opening the inlet check valve while the inlet metering valve is in the closed position.

The means for opening the check valve can be a surface of the inlet metering valve that mechanically displaces the check valve. Preferably, the inlet metering valve is proportionally controllable to travel between an open and a closed position, whereby the normal or stepped-up maximum closed position opens the check valve.

The disclosed method includes the step of a control system opening the inlet check valve while the inlet metering valve is closed and no fuel is to be pumped to the common rail. Preferably, this includes mechanically opening the inlet check valve by a valve element of the inlet metering valve.

Optionally, the inlet metering valve, the inlet check valve, the outlet check valve, and the pressure relief valve are mounted on a common flow axis.

DETAILED DESCRIPTION

Figure 1:
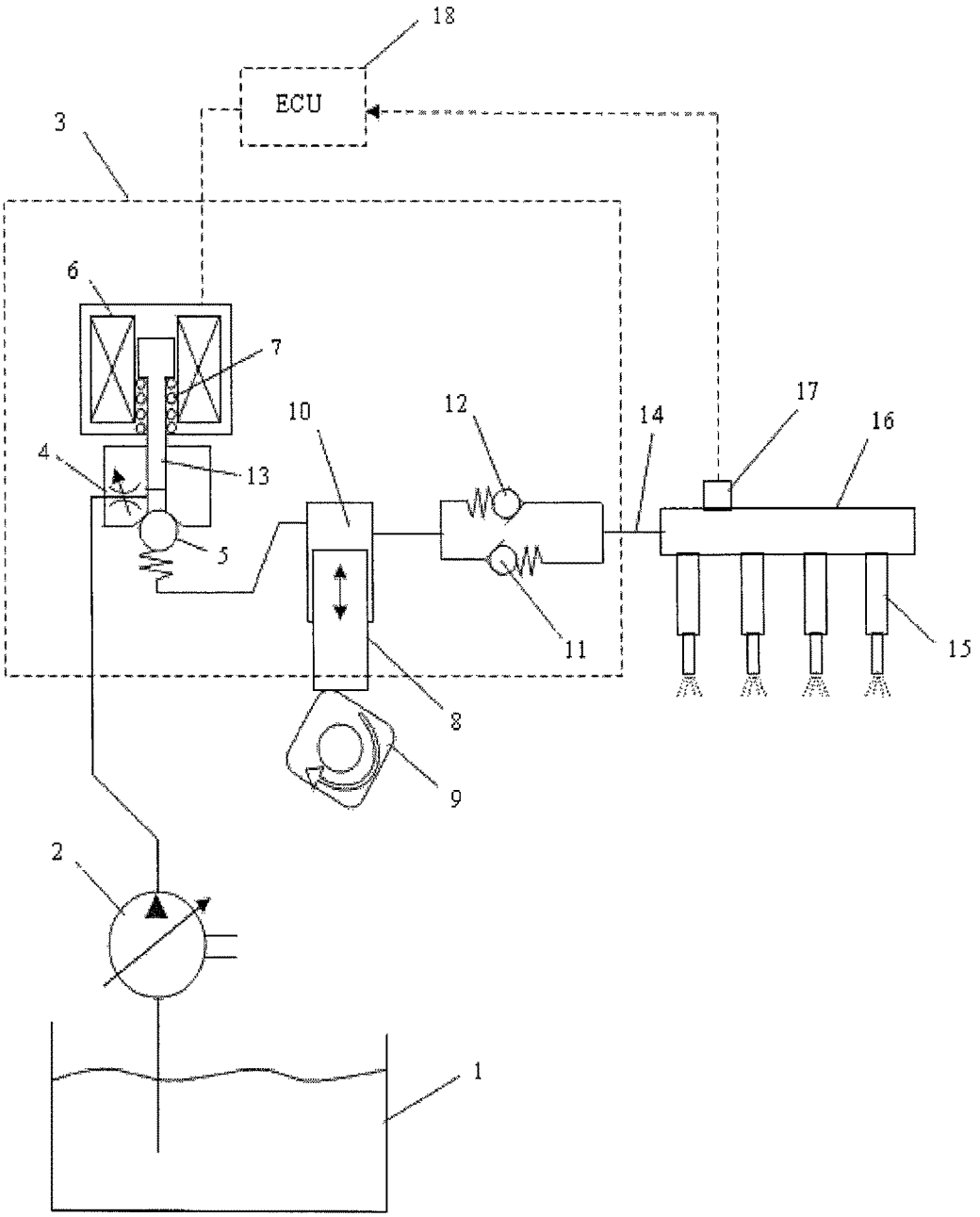
FIG. 1 is a schematic diagram of a fuel injection system incorporating an electrically controlled inlet metered single piston fuel pump.

With reference to the drawings wherein like numerals represent like components, FIG. 1 shows an injection system schematic including an electronically controlled inlet metered single piston fuel pump.

Pump 2 draws fuel from the fuel tank 1 and pumps it through the chassis fuel line and into the inlet passage of the high pressure GDI pump 3. The fuel then flows through the inlet metering (throttle) valve variable opening or orifice 4, then through the inlet check valve 5 and into the pumping chamber 10 during the sucking effect of the charging or intake stroke of the pumping plunger 8. The inlet check valve 5 is situated between the metering valve 13 and the pumping chamber 10, and biased to permit feed flow to the pumping chamber during the intake phase and to prevent fuel pumped at high pressure from flowing into the infeed passage during the pumping phase.

During the pumping stroke, the pumping plunger 8 is driven by the engine cam 9 (usually through a lifter not shown), thereby compressing the fuel in the pumping chamber 10. The compressed fuel then flows through the outlet check valve 11, high pressure line 14 and into the common fuel rail 16. Relief valve 12 assures that the rail pressure does not exceed a safe maximum, but is not controlled for regulating rail pressure according to demand.

The fuel injectors 15 spray atomized fuel into the engine combustion chamber (not shown). The fuel injectors 15 are electronically controlled via the engine ECU 18. The ECU 18 uses the injector 15 control information as well as the electrical signal from common rail pressure sensor 17 to determine the appropriate current level to send to the proportional solenoid 6.

The proportional solenoid 6 generates a magnetic force that acts to move the inlet metering valve element such as piston 13, compressing the inlet metering valve spring 7, and varying the size of the inlet metering valve variable orifice 4, thereby controlling the flow rate through the high pressure pump. In the disclosed embodiment, the orifice size is varied by position of the piston 13 end face with respect to a narrow feed slot on the side of the piston bore. Higher current levels cause additional advancement of the piston 13, until the orifice is completely covered and thus closed, ideally delivering no fuel when commanded. However, a common problem with similar conventional inlet metering valves is leakage between the bore and the piston 13 at the orifice 4 due to wear of the piston and/or the bore, thereby causing un-commanded flow to the pumping chamber 10. Since the pumping plunger 8 continuously reciprocates while the engine is turning, any uncommanded fuel delivered to the pumping chamber 10 will be pressurized and delivered to the rail 16 even if the rail pressures is at a maximum desired or permitted pressure. The present invention alleviates this deficiency.

According to an aspect of the present disclosure, if rail pressure continues to rise when the inlet metering valve variable orifice 4 is fully closed, the ECU sends a higher current level to the proportional solenoid 6. Higher current further advances the inlet metering valve piston 13 from a first closed position that coves the orifice 4 to a second closed position that pushes open the inlet check valve 5. This exposes the pumping chamber 10 to the face of closed valve piston 13. By holding open the inlet check valve 5, any small amount of fuel that leaked by the inlet metering valve piston 13 will pass back and forth across the inlet check valve 5 against or along the pumping piston 13 during the cycles of the pumping plunger 8. The latter creates a hydraulic open circuit (by keeping the inlet check ball from sealing against its seat), and thereby eliminates additional high pressure flow.

Figure 2:
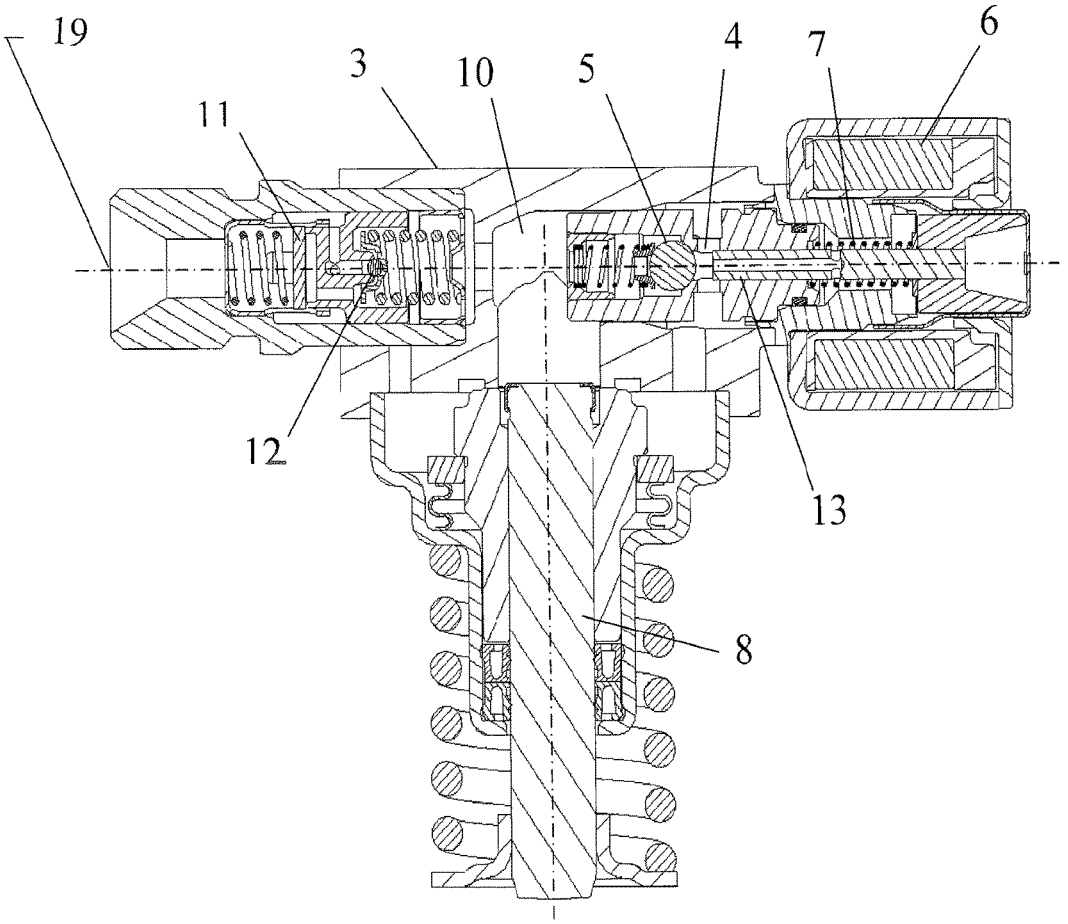
FIG. 2 is a central cross-sectional view of the pump of FIG. 1.
Figure 3:
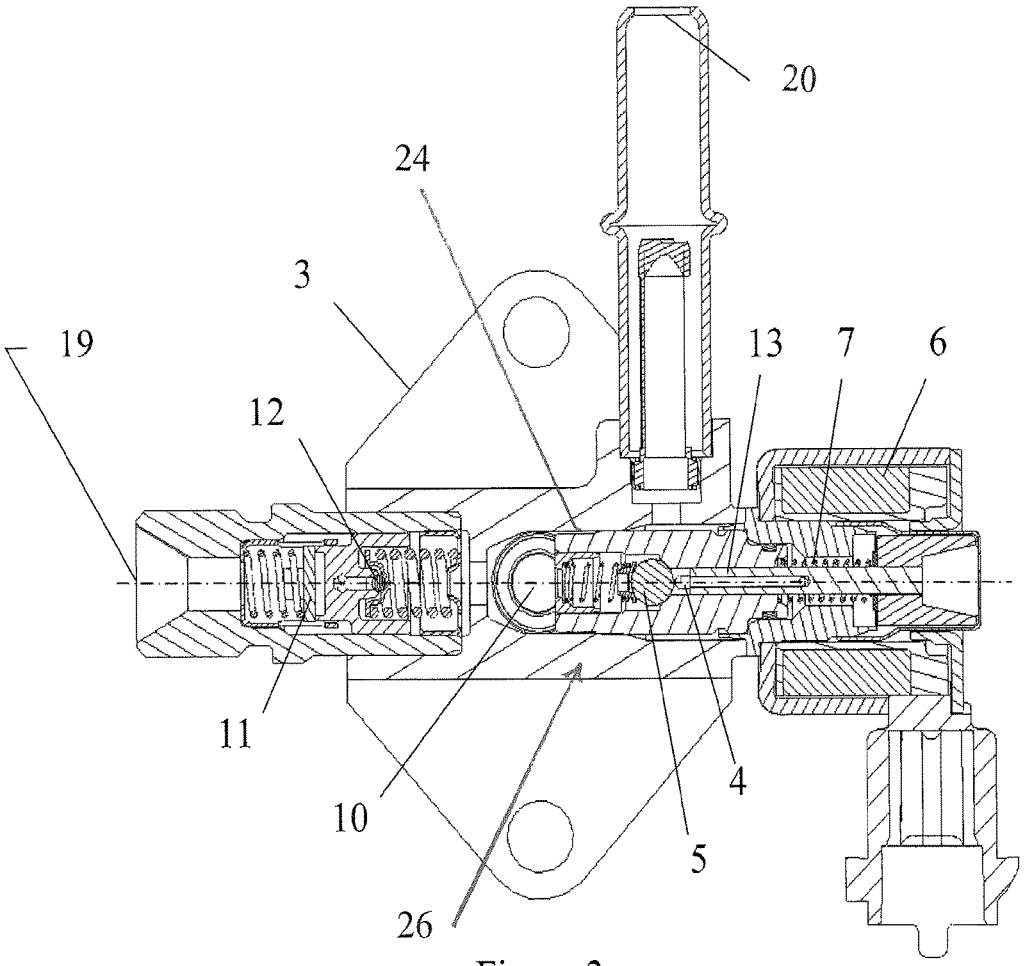
FIG. 3 is a second cross-sectional view of the pump of FIG. 1.

FIG. 2 shows the preferred arrangement of components whereby the inlet metering (throttle) valve 13 with the variable orifice 4, the inlet check valve 5, the outlet check valve 11 and the common rail pressure relief valve 12 are mounted on a common axis. Discharge port 19 delivers to the high pressure line 14. In addition, the inlet metering valve 13 and the inlet check valve 5 are mounted in a common sub-assembly, as also shown in FIG. 3. The pump inlet 20 delivers feed fuel to orifice 4.

Figure 4:
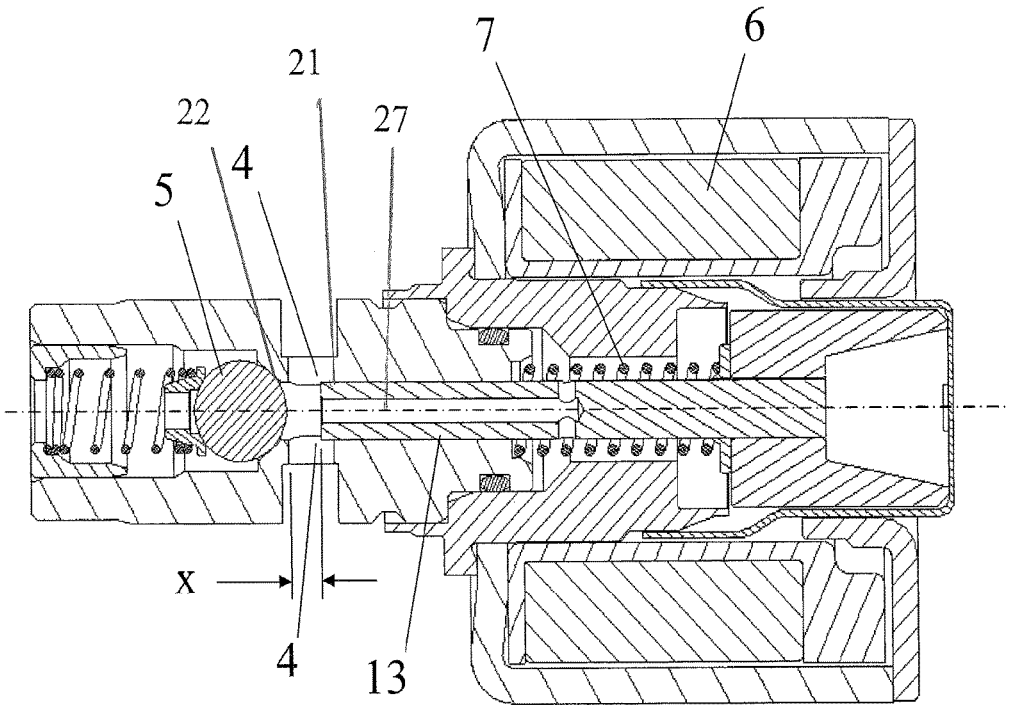
FIG. 4 is a sectional view, partly diagrammatic, of the inlet metering valve and inlet check valve assembly for the pump of FIG. 1.

FIG. 4 shows a cross-section of the inlet metering (throttle) valve and integrated inlet check valve assembly. During normal operation, the ECU 18 provides the proportional solenoid 6 with an appropriate current level to position the inlet metering valve piston 13 within an operating range 'x' in order to adjust the inlet metering valve variable orifice 4 for the desired flow rate through the pump. A normally open inlet metering valve is shown in the FIG. 4, with the variable orifice 4 wide open with no current applied to the proportional solenoid 6.

Within normal operating range 'x', the inlet metering valve piston 13 does not contact the inlet check valve 5. With a tight clearance between the inlet metering valve piston 13 and its bore 21, the flow through the variable orifice 4 will be zero when 'x'=zero. However, if the piston 13 or its bore wears, there could be unwanted flow through the orifice 4 when 'x'=zero. In this case, the ECU 18 can provide a higher current level to the proportional solenoid 6, further advancing the metering valve piston 13 until its face contacts and pushes the inlet check valve 5 to an open position off seat 22. Any flow past the orifice 4 during the pump charging stroke will flow downstream past the open inlet check valve 5, and will then flow backwards toward the open inlet check valve during the pumping stroke because the inlet check ball will be held off its sealing seat 22, thereby delivering no high pressure pump flow.

Figure 5:
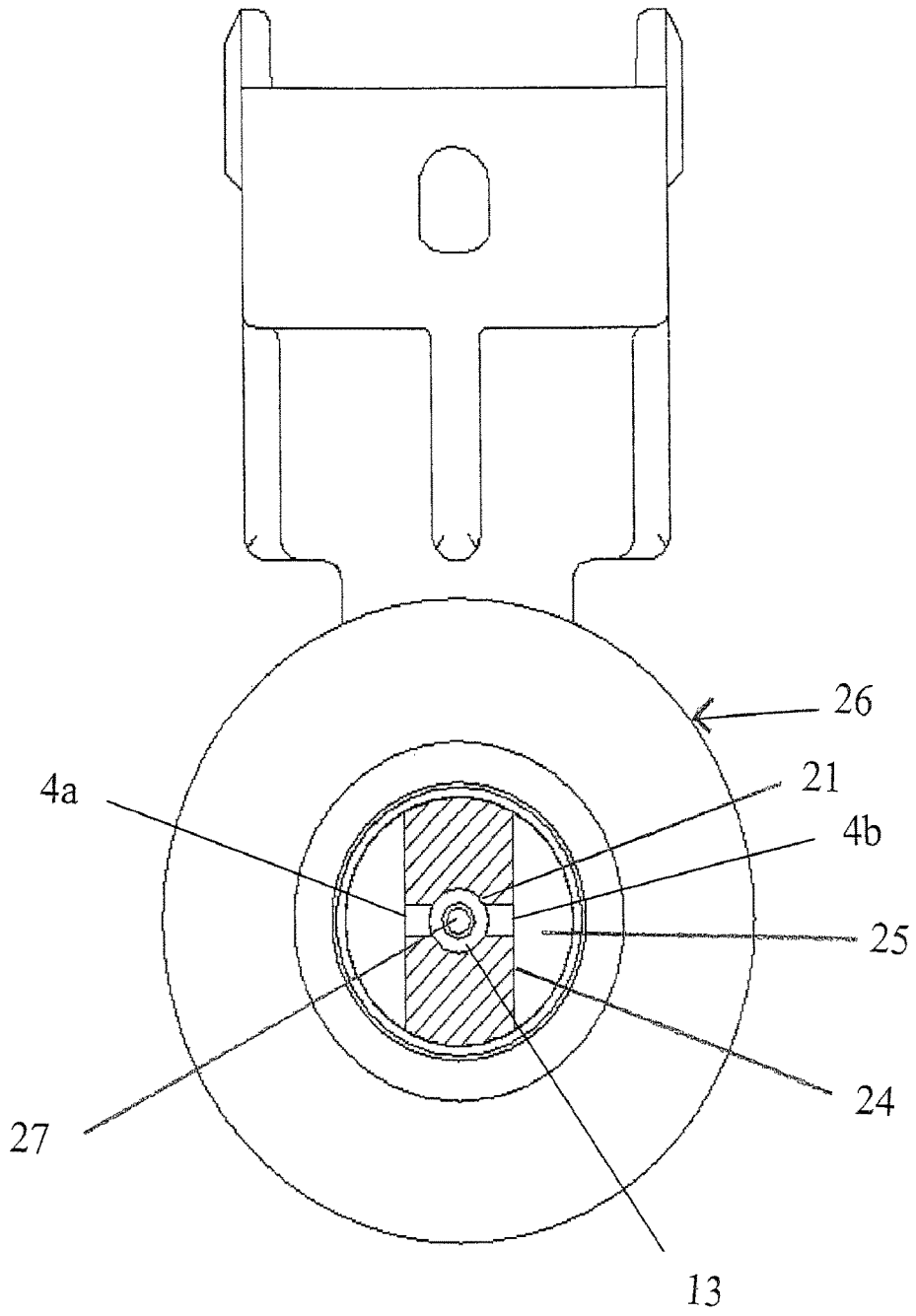
FIG. 5 is an enlarged cross-sectional view of the pump of FIG. 1 showing the inlet metering orifice and its relationship to the metering piston valve.

As shown in FIGS. 3, 4 and 5, the orifice 4 can be in the form of opposed axially aligned slots 4*a*, 4*b* in valve body 24, on either side of piston 13, fed by plenum 25 of the subassembly 26 in fluid communication with the inlet 20. The piston 13 may have an internal bore 27 for providing cooling flow to the internals of solenoid 6.

The key feature is that the control system opens the inlet check valve while the inlet metering valve is closed and no fuel is to be pumped to the common rail. As described above, the solenoid 16 can be controlled to close the piston a distance "x" (shown in FIG. 4) so long as the pressure in the common rail 6 behaves according to the control algorithm, especially for the no demand condition. Only when the pressure in the rail 16 is higher than expected, would the solenoid be controlled to advance the piston 13 beyond distance "x" in order to open the check valve 5. As an alternative, the normally closed position of the piston 13 can always extend beyond "x" and thus always "hang open" the check valve 5 for the no demand condition.

When the inlet check ball 5 is open at no demand, pressure in the pumping chamber 10 will remain lower than the pump inlet pressure. As a consequence, no fuel flow will be forced from the pumping chamber 10 to or through the low pressure side of the pumping plunger 8, and no flow will be forced into the common rail.

The invention claimed is:

1. A fuel pump comprising:

an infeed passage for low pressure feed fuel;

a pumping chamber in fluid communication with the infeed passage;

a pumping plunger reciprocable in the pumping chamber between an intake phase that draws low pressure fuel from the infeed passage into the pumping chamber and pumping phase that increases the pressure in the pumping chamber to a higher pressure for delivery to a common rail through a discharge valve;

an inlet metering valve in the infeed passage for delivering metered quantities of low pressure feed fuel through a variable opening to the pumping chamber, said inlet metering valve having an inlet metering valve member movable between an open position corresponding to maximum flow through the variable opening and a closed position of the metering valve corresponding to zero flow through the variable opening to the pumping chamber;

an inlet check valve between the metering valve and the pumping chamber, biased against a seat to permit feed flow to the pumping chamber during the intake phase and to prevent fuel pumped at high pressure from flowing into the infeed passage during the pumping phase;

an actuator operatively connected to move and maintain said inlet metering valve member in positions between said open and closed positions during said intake phase to vary the opening of the inlet metering valve commensurate with an infeed fuel quantity demand for the intake phase in the pumping chamber; and means for opening the inlet check valve while the inlet metering valve is in said closed position.

2. The fuel pump of claim 1, wherein said inlet metering valve comprises a piston valve element, and said means for opening the check valve is an axial end face of said piston valve element that mechanically displaces the check valve.

3. The fuel pump of claim 1, wherein the inlet metering valve is proportionally controllable to travel between an open and said closed position and said travel to the closed position provides said means for opening the check valve.

4. The fuel pump of claim 3, wherein said inlet metering valve member comprises a piston valve element, and said means for opening the check valve is an axial end face of said piston valve element that mechanically displaces the check valve.

5. The fuel pump of claim 1, wherein the actuator is a proportional solenoid and the inlet metering valve member includes a piston valve element that holds open the inlet check valve only when the piston travels to said closed position.

6. The fuel pump of claim 5, wherein the infeed passage includes an inlet plenum and the opening is an axially aligned slot that is selectively increased and decreased in flow area to present a variable flow cross-section as the inlet metering valve piston travels farther and closer to the check valve, respectively.

7. The fuel pump of claim 6, wherein the inlet check valve is disposed adjacent one end of the slot.

8. The fuel pump of claim 7, wherein at a maximum travel of the piston valve element toward the check valve, the piston valve element closes the slot and a leading end of the piston extends beyond the slot to mechanically open the check valve.

9. The fuel pump of claim 1, wherein the inlet check valve is mounted in a common sub-assembly with the inlet metering valve.

10. The fuel pump of claim 1, wherein the pump includes a high pressure discharge passage from the pumping chamber, an outlet check valve in the high pressure passage, and a pressure relief valve in fluid communication with the high pressure passage; and the inlet metering valve, the inlet check valve, the outlet check valve and the pressure relief valve are all mounted to the pump on a common axis.

11. The fuel pump of claim 1, wherein the inlet metering valve is a normally closed proportional solenoid operated valve with a piston valve element that travels between an open position and said closed position; and the piston valve element has sufficient travel to mechanically hold open the inlet check valve when the piston valve element closes the opening while a zero or a low level of current is supplied to the proportional solenoid.

12. The fuel pump of claim 1, wherein the inlet check valve when seated is disposed at a distance "X" downstream of the opening;

the inlet metering valve is a proportional valve and said inlet metering valve member includes a valve element that travels across said opening between said open position and said closed position to thereby selectively increase and decrease a variable flow cross section of the opening as the inlet metering valve element travels farther from and closer to the check valve, respectively; and at a maximum travel of the valve element toward the check valve, the valve element closes the opening and extends at least the distance "X" beyond the opening to mechanically lift the check valve from its seat.

13. A method of operating a fuel pump with an infeed passage for low pressure fuel; a pumping chamber in fluid communication with the infeed passage; a pumping plunger continuously reciprocable in the pumping chamber commensurate with engine speed between an intake phase that draws low pressure fuel from the infeed passage into the pumping chamber and pumping phase that increases the fuel pressure in the pumping chamber for delivery to a common rail through an outlet check valve; a metering valve in the infeed passage for delivering metered quantities of low pressure fuel to the pumping chamber, said metering valve including a metering valve element movable between an open position corresponding to maximum flow through said infeed passage and a closed position corresponding to no flow through said infeed passage; an inlet check valve between the inlet metering valve and the pumping chamber, biased to permit feed flow to the pumping chamber during the intake phase and prevent fuel pumped at high pressure from flowing into the infeed passage during the pumping phase; and a control system that displaces the metering valve element among positions maintained between said open and closed positions during said intake phase according to demand for pumped fuel, said control system closes the metering valve when no fuel is to be pumped to the common rail; wherein the improvement comprises a step wherein the control system opens the inlet check valve while the inlet metering valve is closed and no fuel is to be pumped to the common rail.

14. The method of claim 13, wherein the improvement comprises mechanically opening the inlet check valve by said metering valve element of the inlet metering valve.

15. The method of claim 13, wherein the improvement comprises that the inlet metering valve receives inlet flow through an inlet flow orifice;

the control system controls a proportional solenoid that displaces the inlet metering valve element across the inlet flow orifice between said open and closed positions according to demand for pumped fuel; and the metering valve element is displaceable to a maximum closed position that closes the inlet flow orifice and opens the inlet check valve.

16. The method of claim 15, wherein the improvement comprises positioning the displaceable valve element to completely cover the inlet flow orifice in a first closed valve position when the control system determines that no fuel is required to be pumped into the common rail;

determining whether the pressure in the common rail exceeds a threshold pressure while the control system determines that no fuel is required to be pumped into the common rail; and if the pressure in the common rail exceeds said threshold pressure while the control system determines that no fuel is required to be pumped into the common rail, further displacing the valve element into said maximum closed position that mechanically opens the inlet check valve while the valve element continues to completely cover the inlet orifice.

* * * * *